US011097816B1

(12) United States Patent
O'Malley, Jr.

(10) Patent No.: US 11,097,816 B1
(45) Date of Patent: Aug. 24, 2021

(54) MOORING BUOY SHACKLE DEFLECTOR

(71) Applicant: Joseph M. O'Malley, Jr., Barrington, IL (US)

(72) Inventor: Joseph M. O'Malley, Jr., Barrington, IL (US)

( * ) Notice: Subject to any disclaimer, the term of this patent is extended or adjusted under 35 U.S.C. 154(b) by 0 days.

(21) Appl. No.: 16/904,431

(22) Filed: Jun. 17, 2020

Related U.S. Application Data

(60) Provisional application No. 62/866,516, filed on Jun. 25, 2019.

(51) Int. Cl.
*B63B 59/02* (2006.01)
*B63B 22/02* (2006.01)

(52) U.S. Cl.
CPC ..... *B63B 59/02* (2013.01); *B63B 22/02* (2013.01)

(58) Field of Classification Search
CPC ..... B63B 59/00; B63B 59/02; B63B 22/00; B63B 22/02
USPC ..... 441/3
See application file for complete search history.

(56) References Cited

U.S. PATENT DOCUMENTS 6,955,574 B2 * 10/2005 Rogerson ..... B63B 22/02 441/3
7,438,616 B2 * 10/2008 Nanson ..... B63B 59/02 441/3

* cited by examiner

*Primary Examiner* — Lars A Olson
(74) *Attorney, Agent, or Firm* — Quickpatents, LLC; Kevin Prince

(57) ABSTRACT

A deflector for a mooring buoy of the type having a raised shackle includes a mounting plate that has a top side, a bottom side, and at least one peripheral edge. A shackle aperture traverses a center portion of the mounting plate and is adapted for receiving the shackle therethrough. A cage projects upwardly from the at least one peripheral edge of the mounting plate and terminates at an upper rim. The cage has a plurality of apertures therethrough and two or more tie apertures adjacent the shackle aperture. In use, the shackle of the buoy is inserted into the shackle aperture and the cage is rotated 90-degrees to secure the deflector to the buoy. Ties are then fastened through the tie apertures and the through the shackle to further secure the deflector to the mooring buoy.

8 Claims, 3 Drawing Sheets

MOORING BUOY SHACKLE DEFLECTOR

CROSS-REFERENCE TO RELATED APPLICATIONS

This application claims the benefit of U.S. Provisional Patent Application 62/866,516, filed on Jun. 25, 2019, and is incorporated herein by reference.

STATEMENT REGARDING FEDERALLY SPONSORED RESEARCH AND DEVELOPMENT

Not Applicable.

FIELD OF THE INVENTION

This invention relates to buoys, and more particularly to a buoy shackle deflector.

BACKGROUND

Mooring buoys are built to withstand the elements and, as such, are often made of metal or other strong rigid materials that can damage boats during contact. Softer, more resilient materials have been used to cover buoys, but often such covers have drawbacks such as being difficult to attach to and maintain on the buoy. Further, multi-part covers of the prior art are complicated to attached to the buoy and are relatively expensive. Prior art buoy covers intend to cover much of the buoy to protect it from the elements, but with modern buoy materials this isn't necessary.

Therefore, there is a need for a device that can be readily attached to a buoy and secured easily with inexpensive cable ties, zip ties or the like. Such a needed invention would be made of a semi-resilient plastic material that protects a boat hull during contact, preventing a more rigid and potentially damaging direct contact with the buoy. Further, such a needed invention would be inexpensive to manufacture, easy to store and transport in a nested stack, and would be easy to remove and replace if damaged. Maintenance of the deflector comprises visual inspection and occasional replacement if necessary. The present invention accomplishes these objectives.

SUMMARY OF THE INVENTION

The present device is a deflector for a mooring buoy of the type having a raised shackle. The deflector includes a mounting plate that has a top side, a bottom side, and at least one peripheral edge. A shackle aperture traverses a center portion of the mounting plate and is adapted for receiving the shackle therethrough. In some embodiments, wherein the buoy has a raised ring-type shackle, the shackle aperture is elongated to receive the shackle therethrough.

A cage projects upwardly from the at least one peripheral edge of the mounting plate and terminates at an upper rim. The cage has a plurality of apertures therethrough. In some embodiments the cage includes strengthening ribs between each aperture extending from the mounting plate to the upper rim.

In some embodiments the mounting plate further includes two or more tie apertures adjacent the shackle aperture, such that one or more ties can be fastened through the tie apertures and through the shackle to further secure the deflector to the mooring buoy. Such ties may be cable ties, or tie wraps, zip-ties or the like.

In use, the shackle of the buoy is inserted into the shackle aperture and the cage is rotated 90-degrees to secure the deflector to the buoy. In some embodiments a metallic locking plate can further be added to reinforce the mounting plate. The ties are then fastened through the tie apertures of the cage and, in some instances, cooperative tie apertures of the locking plate, and the through the shackle to further secure the deflector to the mooring buoy.

The present invention is a device that can be readily attached to a buoy and secured easily with cable ties or the like, preferably with those having a relatively high strength and UV endurance rating. The present invention is made of a semi-resilient plastic material that protects a boat hull during contact, preventing a more rigid and potentially damaging direct contact with the buoy. Further, the present device is inexpensive to manufacture, easy to store and transport in a nested stack, and is easy to remove and replace if damaged even with deployed buoys. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
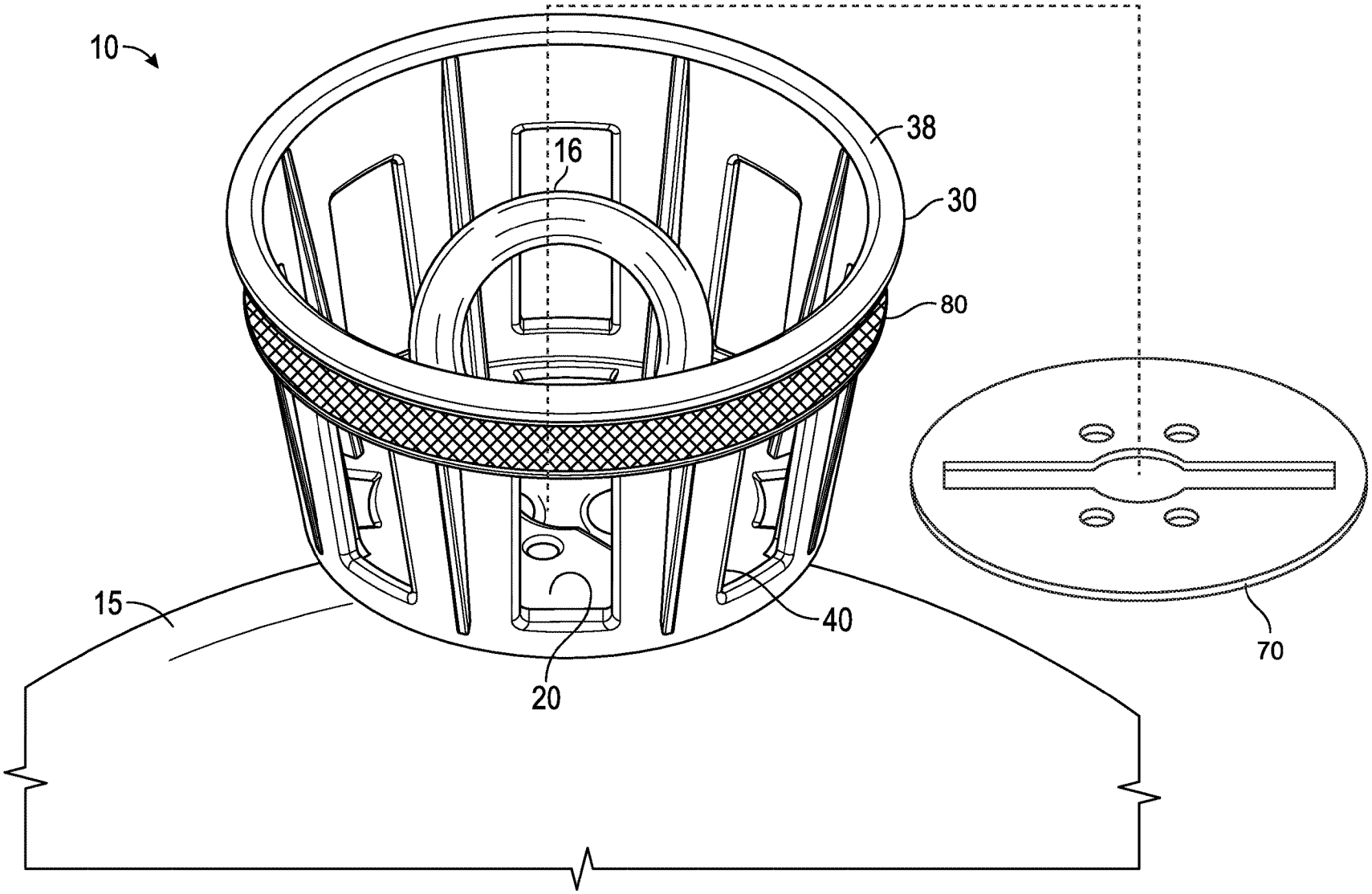
FIG. 1 is a perspective view of the invention as mounted with a mooring buoy.
Figure 2:
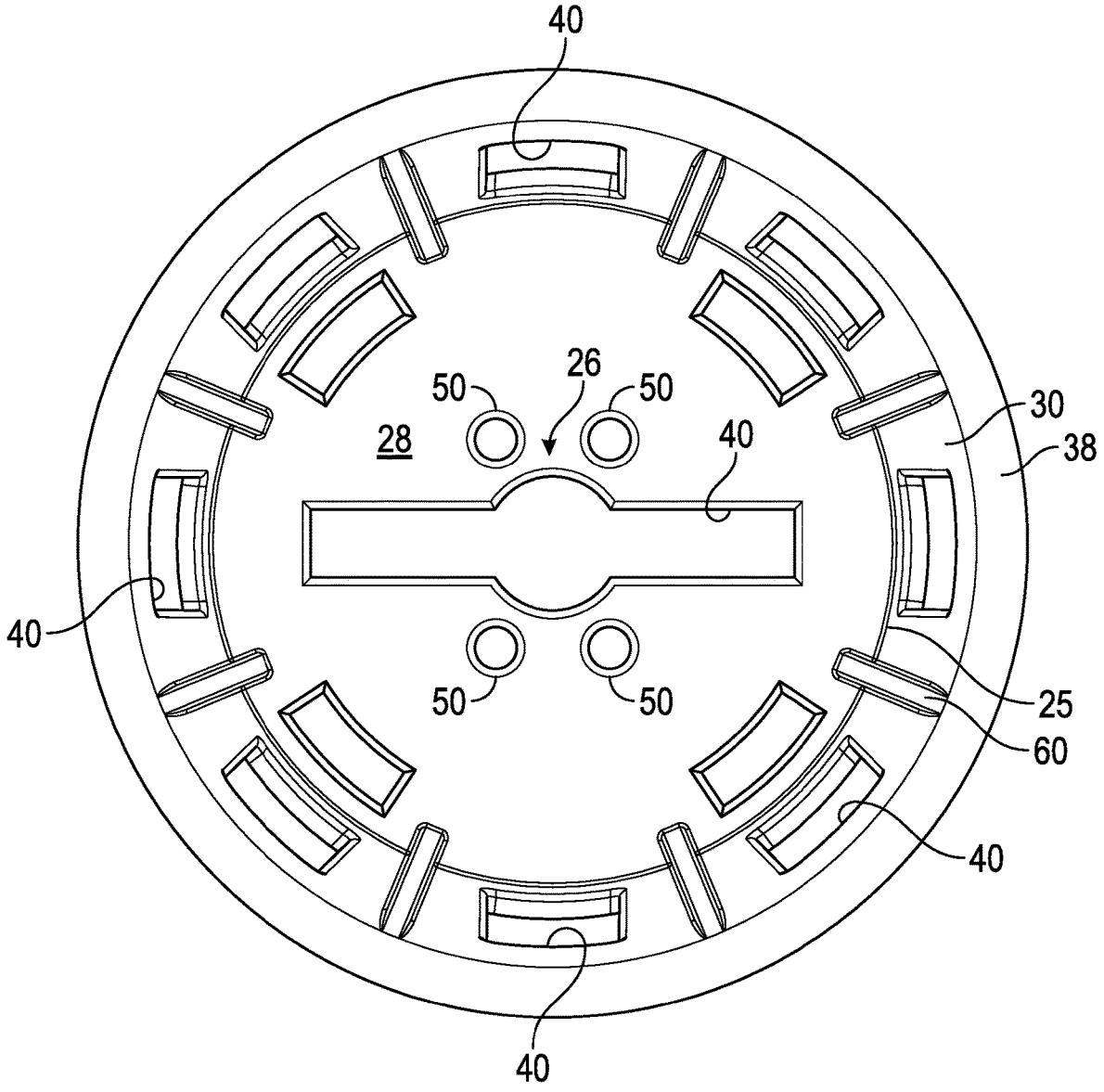
FIG. 2 is a top plan view of the invention.
Figure 3:
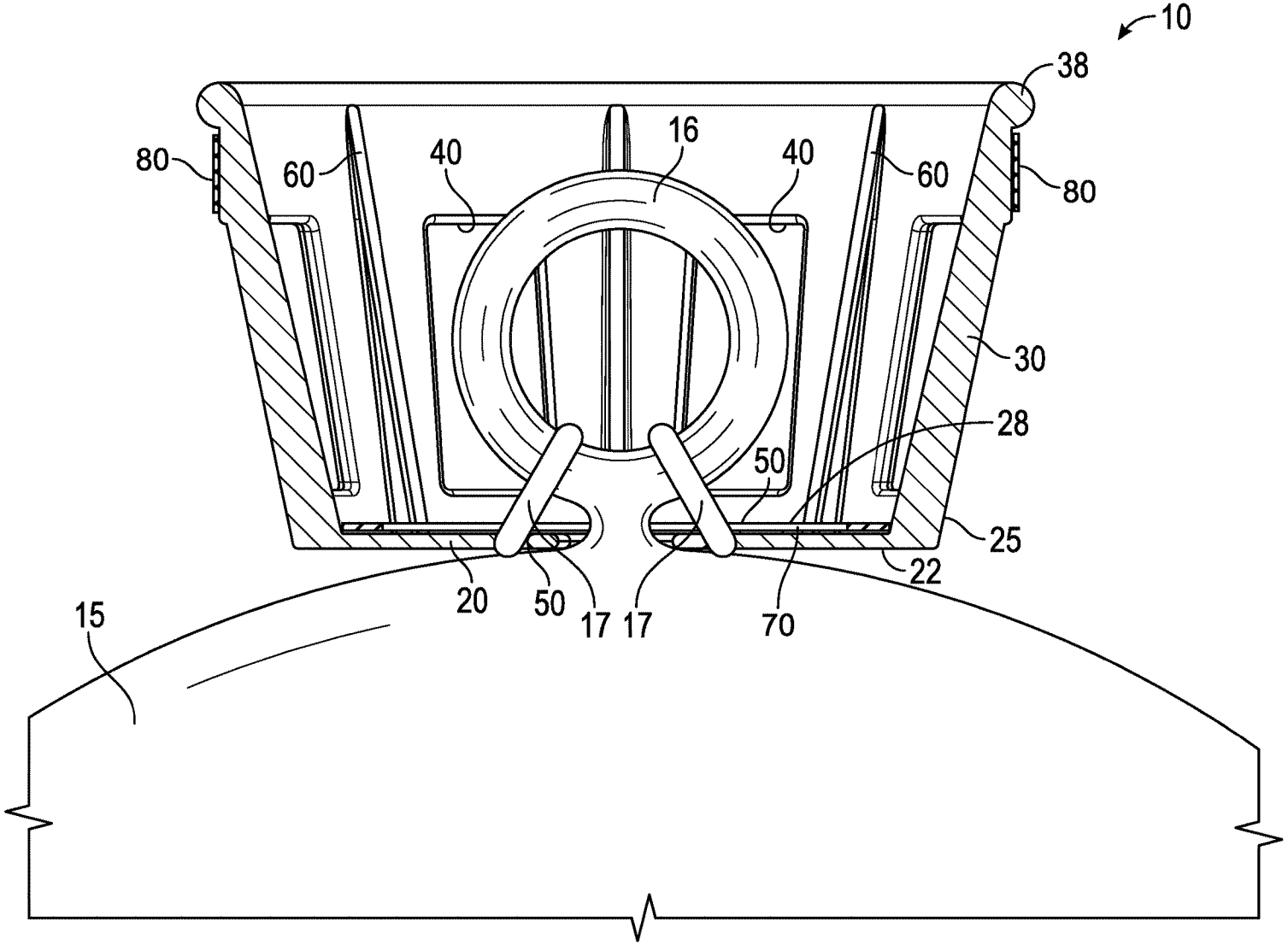
FIG. 3 is a cross-sectional view of the invention as mounted on the mooring buoy, the cross-sectional view taken along a longitudinal axis of an elongated shackle aperture of a mounting plate of the invention.

FIGS. 1-3 illustrate a deflector 10 for a mooring buoy 15 of the type having a raised shackle 16. The deflector 10 includes a mounting plate 20 that has a top side 28, a bottom side 22, and at least one peripheral edge 25. A shackle aperture 40 traverses a center portion 26 of the mounting plate 20 and is adapted for receiving the shackle 16 therethrough. In some embodiments, wherein the buoy has a raised ring-type shackle 16, the shackle aperture 40 is elongated to receive the shackle 16 therethrough.

A cage 30 projects upwardly from the at least one peripheral edge 25 of the mounting plate 20 and terminates at an upper rim 38. The cage 30 has a plurality of apertures 40 therethrough. In some embodiments the cage includes strengthening ribs 60 extending from proximate the mounting plate 20 to proximate the upper rim 38.

Preferably the mounting plate 20 and the cage 30 are integrally formed from an injection-molded plastic material that is resistant to seagrass, barnacle, or other growth, and that has a relatively high UV resistance rating to endure direct sun during daytime. Preferably the deflector 10 is made from a semi-rigid or resilient plastic material that is durable in harsh salt-water and sunny environments. Further, preferably the cage 30 is angled with the mounting plate 20 less than 90-degrees, such that multiple deflectors 10 may be nested and stacked.

In some embodiments the mounting plate 20 further includes two or more tie apertures 50 adjacent the shackle aperture 40, such that one or more ties 17 can be fastened through the tie apertures 50 and through the shackle 16 to further secure the deflector 10 to the mooring buoy 15. Such ties 17 may be cable ties, zip-ties, rope (not shown), metal or plastic rings (not shown), or the like.

In use, the shackle 16 of the buoy 15 is inserted into the shackle aperture 40 and the cage 30 is rotated 90-degrees to secure the deflector 10 to the buoy 15. The ties 17 are then fastened through the tie apertures 50 and the through the shackle 16 to further secure the deflector 10 to the mooring buoy 15.

The deflector 10 may, in some embodiments, include a reflective tape 80 or other reflective surface on the cage 30. Further, the deflector 10 may further include an optional galvanized steel locking plate 70 adapted to reinforce the mounting plate 20.

While a particular form of the invention has been illustrated and described, it will be apparent that various modifications can be made without departing from the spirit and scope of the invention. For example, while the shape of the mounting plate 20 and cage 30 is circular in top plan view in the figures, other shapes could be utilized such as square, hexagon, octagon, rectangular, oval, or the like. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A deflector for a mooring buoy of the type having a raised shackle, comprising:

a mounting plate having a top side, a bottom side, and at least one peripheral edge, a shackle aperture traversing a center portion of the mounting plate and adapted for receiving the shackle therethrough;

a cage projecting upwardly from the at least one peripheral edge of the mounting plate and terminating at an upper rim, the cage having a plurality of apertures therethrough;

whereby inserting the shackle of the buoy into the shackle aperture and rotating the cage secures the deflector on the mooring buoy.

2. The deflector of claim 1 wherein the shackle aperture is elongated and adapted for receiving a ring-type shackle of the mooring buoy.

3. The deflector of claim 2 wherein the mounting plate further includes two or more tie apertures adjacent the shackle aperture, whereby one or more ties can be fastened through the tie apertures and through the shackle to further secure the deflector to the mooring buoy.

4. The deflector of claim 1 wherein the mounting plate and the cage are integrally formed from an injection-molded plastic material.

5. The deflector of claim 4 wherein the cage is angled with the mounting plate less than 90-degrees, such that multiple deflectors may be nested and stacked.

6. The deflector of claim 4 wherein the cage further includes a plurality of strengthening ribs between each aperture extending from the mounting plate to the upper rim.

7. The deflector of claim 6 wherein the cage is produced by a rotational-molding process.

8. A deflector for a mooring buoy of the type having a ring-type raised shackle, comprising:

a mounting plate having a top side, a bottom side, and at least one peripheral edge, an elongated shackle aperture traversing a center portion of the mounting plate and adapted for receiving the shackle therethrough, the mounting plate further including two or more tie apertures adjacent the shackle aperture;

a cage projecting upwardly from the at least one peripheral edge of the mounting plate and terminating at an upper rim, the cage having a plurality of apertures therethrough, the mounting plate and the cage being integrally formed from an injection-molded plastic material, the cage being angled with the mounting plate less than 90-degrees, such that multiple deflectors may be nested and stacked;

whereby inserting the shackle of the buoy into the shackle aperture and rotating the cage secures the deflector on the mooring buoy, and one or more ties can be fastened through the tie apertures and through the shackle to further secure the deflector to the mooring buoy.

* * * * *